US007562787B2

(12) United States Patent
Serrano

(10) Patent No.: US 7,562,787 B2
(45) Date of Patent: Jul. 21, 2009

(54) BEVERAGE HOLDER AND TRANSPORT SYSTEM

(76) Inventor: Raymond F Serrano, 1076 E. Fremont Cir. So, Centennial, CO (US) 80122

( * ) Notice: Subject to any disclaimer, the term of this patent is extended or adjusted under 35 U.S.C. 154(b) by 259 days.

(21) Appl. No.: 11/622,221

(22) Filed: Jan. 11, 2007

(65) Prior Publication Data

US 2008/0169292 A1 Jul. 17, 2008

(51) Int. Cl.
*B65D 1/36* (2006.01)

(52) U.S. Cl. ..... 220/507; 220/752; 220/510; 220/23.89; 206/139; 206/164; 206/203

(58) Field of Classification Search ..... 220/507, 220/752, 510, 738, 495.03, 23.89, 23.87; 206/139, 162, 164, 199, 201, 203; 215/397; 211/74, 77

See application file for complete search history.

(56) References Cited

U.S. PATENT DOCUMENTS 149,407 A * 4/1874 Landon et al. ..... 294/143
150,718 A * 5/1874 Seavey ..... 211/77
367,329 A * 7/1887 Witherell ..... 211/77
948,524 A * 2/1910 Reid ..... 294/143
1,199,987 A * 10/1916 Husted ..... 206/19
1,448,259 A * 3/1923 Cook ..... 294/143
1,659,344 A * 2/1928 Wissman ..... 294/143
1,681,110 A * 8/1928 Friedman ..... 206/199
D93,916 S 11/1934 Erickson
1,997,587 A * 4/1935 Kolb ..... 294/161
2,510,591 A * 6/1950 Listman ..... 206/199
2,615,605 A * 10/1952 Wahlbom ..... 206/164
2,682,972 A * 7/1954 Ringler ..... 206/164
2,740,546 A * 4/1956 Kowalski ..... 220/23.88
2,759,629 A * 8/1956 Sargent ..... 206/199
2,896,829 A * 7/1959 Bright ..... 294/143
2,946,456 A * 7/1960 Liguori ..... 211/77
2,997,169 A * 8/1961 Poupitch ..... 206/150
D194,985 S * 4/1963 Rifkind et al. ..... D7/706
3,160,306 A * 12/1964 Smalley ..... 220/512
3,215,308 A * 11/1965 Finley et al. ..... 206/199
3,240,385 A * 3/1966 Gits ..... 206/199
3,276,621 A * 10/1966 Tolaas ..... 206/157
3,565,323 A * 2/1971 Katzenmeyer ..... 229/117.14
3,643,812 A * 2/1972 Mander et al. ..... 211/74
3,724,654 A 4/1973 Gerard et al.
3,908,877 A * 9/1975 Kosisky ..... 294/143
4,196,807 A * 4/1980 Brom ..... 206/427
4,394,905 A 7/1983 Hackenberg
4,501,363 A * 2/1985 Isbey, Jr. ..... 206/570
4,565,401 A 1/1986 Young, Jr.
4,643,312 A 2/1987 Zarges (Continued)

*Primary Examiner*—Anthony D Stashick
*Assistant Examiner*—Christopher B McKinley
(74) *Attorney, Agent, or Firm*—Leyendecker & Lemire, LLC; Kurt Leyendecker

(57) ABSTRACT

A beverage hold and transport system is described typically for transporting a plurality of cups of coffee or other beverages. In one system, one or more trays can be suspended from an upper tray that is adapted to be carried by a person using a single hand thereby increasing the number of beverages the person can transport. In another system, a mechanism for removably attaching a container to the bottom of the tray is provided such that any spills from the beverages contained in the tray are directed into the container and not on to a surface therebelow.

17 Claims, 4 Drawing Sheets

U.S. PATENT DOCUMENTS 4,694,961 A 9/1987 Menendez
4,947,991 A * 8/1990 Snell ..... 206/427
D311,115 S 10/1990 Abraham
D316,499 S * 4/1991 Coffey ..... D7/409
D323,956 S * 2/1992 Abrams ..... D7/600
5,118,063 A 6/1992 Young, Sr.
5,133,939 A * 7/1992 Mahe ..... 422/104
D330,513 S 10/1992 Gilchrist
D335,244 S 5/1993 Abrams
5,333,751 A * 8/1994 Santucci, Sr. ..... 206/423
D352,424 S 11/1994 Asner
5,392,923 A 2/1995 Hassard et al.
5,524,814 A * 6/1996 Davis ..... 229/117.08
5,540,334 A 7/1996 Haas et al.
5,609,379 A * 3/1997 Harrelson ..... 294/87.2
5,765,690 A 6/1998 Baxter
D396,133 S 7/1998 Stein
5,788,301 A * 8/1998 Slomski ..... 294/87.2
5,833,056 A * 11/1998 Goldman ..... 206/199
5,899,353 A * 5/1999 Sabin et al. ..... 220/507
5,938,060 A * 8/1999 Rutland, Jr. ..... 220/23.6
D414,991 S 10/1999 Brown
5,967,323 A 10/1999 Siragusa
5,979,646 A 11/1999 Strachan
D424,425 S 5/2000 Ngai
D426,431 S 6/2000 Kuroski
6,109,857 A * 8/2000 Trygg ..... 414/626
6,186,351 B1 * 2/2001 Coyle ..... 220/23.83
6,234,309 B1 * 5/2001 Aikio ..... 206/427
6,523,693 B1 2/2003 Eggenberger et al.
6,832,687 B2 * 12/2004 Davis ..... 206/549
D505,600 S 5/2005 Woody
D526,169 S 8/2006 Zafiropoulos
7,108,128 B2 9/2006 Borg
7,185,758 B2 * 3/2007 Cuomo ..... 206/162
7,267,224 B2 * 9/2007 Cuomo ..... 206/175
2002/0170868 A1 * 11/2002 Morgan ..... 211/77
2004/0195144 A1 10/2004 Smith
2006/0016719 A1 1/2006 Cassese et al.
2006/0108251 A1 5/2006 Sherrer et al.
2007/0017827 A1 * 1/2007 Urquhart et al. ..... 206/162
2007/0045206 A1 * 3/2007 Tiemann ..... 211/77
2007/0193890 A1 * 8/2007 Cuomo ..... 206/162
2008/0110772 A1 * 5/2008 Picciolo ..... 206/162
2008/0237087 A1 * 10/2008 Cieri ..... 206/579

* cited by examiner

BEVERAGE HOLDER AND TRANSPORT SYSTEM

FIELD OF THE INVENTION

The present invention relates generally to holds typically used to transport beverages contained in cup or other receptacles.

BACKGROUND

It is common for one person in a workplace to make a coffee and beverage run for other co-workers. A coffee run may comprise taking an elevator to the food court and back in an office high rise, or in other situations, the person making the run may have to drive to a coffee vendor, such as but certainly not limited to Starbucks™. No matter where the person must go to get the coffee or other beverages, the person must typically transport a plurality of cups back to his/her co-workers.

Traditionally, the person will place the cups of coffee in cardboard trays that are provided by the beverage purveyor and have a centered handle that extends upwardly from the tray. These trays typically carry four or in some instances, six cups of coffee. If the coffee run is for more than four or six cups, the person must typically carry two holders: one in each hand. Of course, in such situations, the person cannot easily open building and automobile doors, and retrieve keys, money, wallets or other items from his/her pockets or purse.

Larger trays are known, such as those used by concessionaires in ballparks; however, these trays cannot be conveniently carried using a single hand and often require a neck strap. They certainly are not suitable or practical for a person on an office coffee run.

Another problem of using cardboard trays in certain situations is spillage of the coffee or other beverages contained in the cups. Cardboard trays often do not have the necessary structure or configuration to contain any spillage from the cups in or on the tray. Accordingly, spillage can cause soiling of office carpets. Further spillage often occurs when the tray is set on a front passenger seat of an automobile and the coffee sloshes around, over the top of the cups as the person driving the automobile accelerates and decelerates.

DETAILED DESCRIPTION

Figure 1:
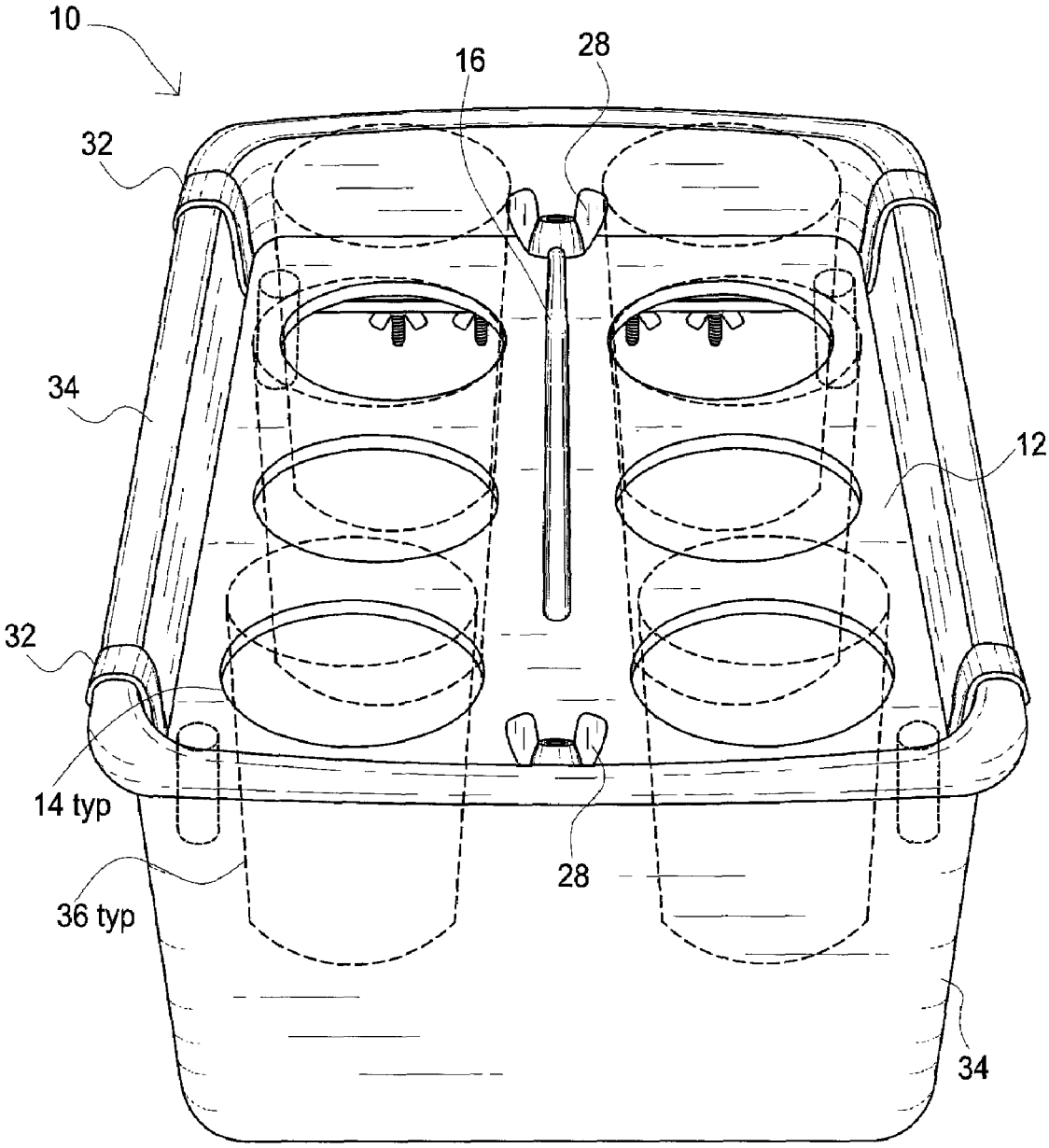
FIG. 1 is isometric of a beverage holder and associated spill collection container attached thereto according to one embodiment of the invention.

Embodiments of the invention comprise a tray for carrying multiple beverages contained in partially frustoconical cups or similar receptacles. In one variation, the tray comprises a rectangular plate of rigid material, typically plastic, with includes an array of cup-sized apertures arranged thereon. A handle extends upwardly from the center of the plate, and in at least one embodiment, the handle is comprised of an inverted U-shaped rod that has threaded ended upon which nuts are secured thereto hold the handle in place.

Proximate either end of the plate, an upper portion of an attachment mechanism is attached to the plate, which when paired with a lower portion of the attachment mechanism couples the plate with a container that the plate generally overlies. The lower portion of the attachment mechanism is typically hooked around the lip of the container such that it is firmly but removably secured thereon. Accordingly and advantageously, liquid that spills out of the cups carried in the cup-sized apertures is caught and contained in the container and does not soil and/or wet any underlying surface, such as office carpets or the seats of an automobile.

The attachment mechanism between the plate and the container may vary in different embodiments; however, the mechanism in the illustrated embodiment permits the container and the plate to be decoupled without having to slant or cant the plate relative to the container. This is in contrast to Tupperware-type covers of plastic containers that coupled to the entirety of the periphery of a container's lip wherein the cover is typically pulled upwardly canting it relative to the lip of the container. As can be appreciated, a Tupperware-type attachment means can be utilized in variations of the present invention, but such a mechanism, which would require a relatively stiff center portion to support the cups, could cause some of the contents of cups held in the cup-sized apertures to spill when the plate is canted during decoupling. For a 14" long tray, the tray using a Tupperware-type snap lip sealing mechanism combined with a stiff center portion may need to be canted between 5-30 degrees to remove the tray.

In certain variations of the beverage holder and transport system are adapted to carry two or more layers of the plates in an overlying (or double-decker) relationship with each other. Specifically in the illustrated embodiments, a pair of hooks depend from an upper plate and hook around the handle of a lower plate. Accordingly, a user using a single hand can easily transport twelve beverage cups. Also advantageously, the lower plate can pivot and swing relative to the top plate thereby permitting it to retain a horizontal orientation even if the top plate is canted somewhat during transport.

Terminology

The terms and phrases as indicated in quotes (" ") in this section are intended to have the meaning ascribed to them in this Terminology section applied to them throughout this document including the claims unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases mean that a particular feature, structure, or characteristic described in connection with the embodiment is included in at least an embodiment of the invention. The appearances of the phrase "in one embodiment" in various places in the specification are not necessarily all meant to refer to the same embodiment.

The term "couple" or "coupled" as used in this specification and the appended claims refers to either an indirect or a direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

Embodiments of a Beverage Holder and Transport System

Figure 2:
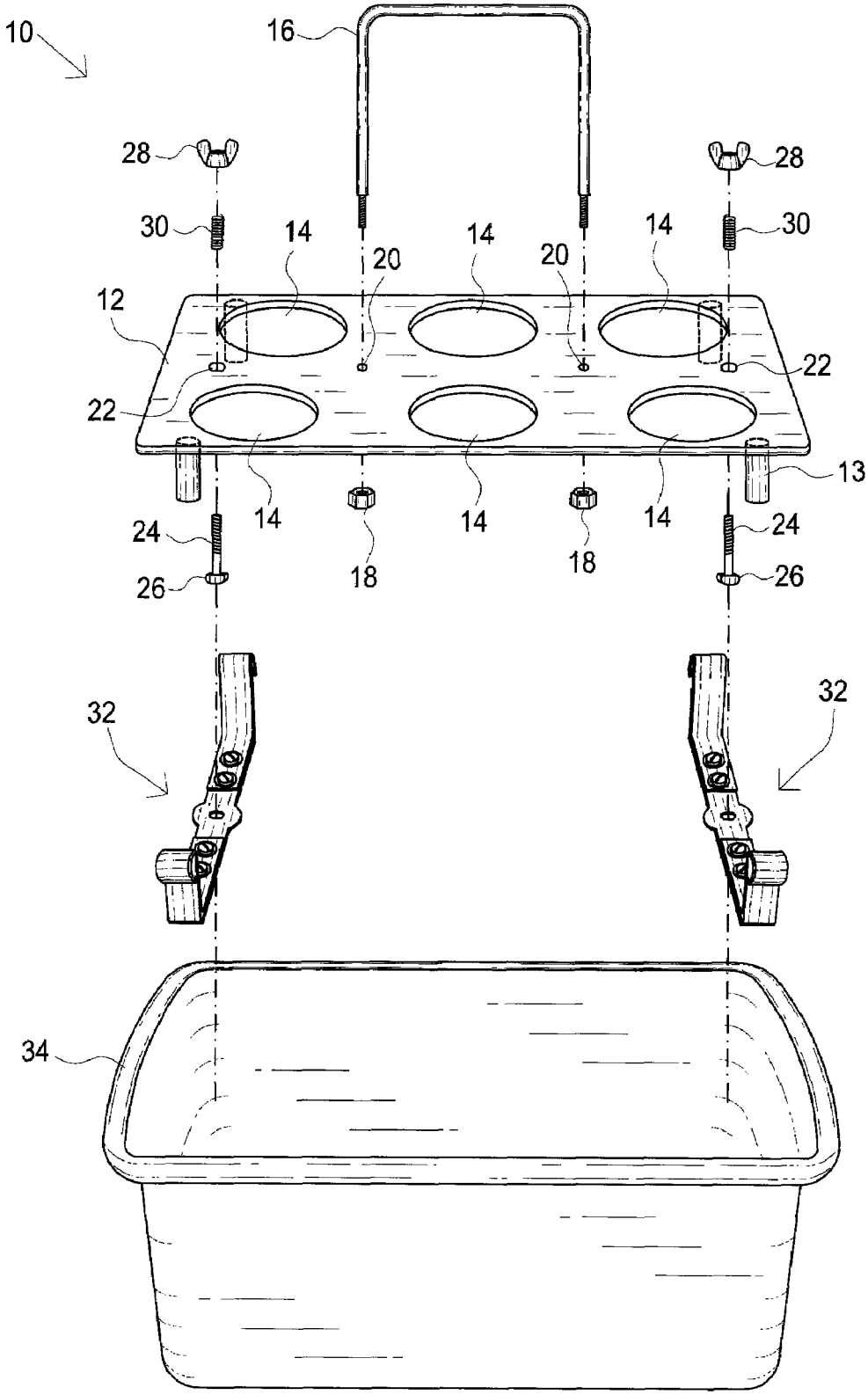
FIG. 2 is an exploded view of the holder of FIG. 1 sans the container according to an embodiment of the invention.

In FIGS. 1-3 an embodiment of the beverage holder and transport system 10 is illustrated. In general, the system comprises: (i) a square or rectangular tray 12 comprised of a substantially rigid material; (ii) a handle assembly 16& 18 coupled to the plate to permit a user to carry the holder with a single hand; (iii) an upper portion 24,28&30 and a lower portion 32 of two attachment mechanisms for securing the tray to a container 34; and (iv) the container.

As mentioned, the tray 12 is typically comprised of a substantially rigid material, such as a suitable plastic. In at least one variation, the tray is comprised of a transparent or translucent acrylic plate. In other variations, the tray can be comprised of polypropylene, nylon, ABS, polycarbonate, polyethylene or any other suitable plastic material. The material can be reinforced or unreinforced. Further, stiffening ridges can be fabricated into the tray to enhance its stiffness and resistance to bending when laden with beverages. In yet other variations, the tray can be comprised of other non-polymeric materials including paper, wood and metal.

The tray 12 typically comprises a flat and generally rectangular plate of a suitable thickness to inhibit and prevent the plate from bending appreciably when loaded with beverages. A variation adapted to carry four beverage cups may be nearly square; whereas, a variation adapted to carry six beverage cups, such as the illustrated embodiment, will typically have one side that is longer than the other side. For instance, one variation that is adapted to carry six beverage cups comprises an acrylic plate having a length of about 14.0", a width of about 9.25" and a thickness of about 0.19". Further, variations of the plate are contemplated that comprise other shapes including circular and oval. However, rectangular plates are often preferred as stock off-the-self containers that can couple with the plate most often have rectangular openings.

In some embodiments, the tray may comprise thinner and more flexible sheets of material that are configured into a boxlike structure to provide suitable rigidity. The box-like structure may do away with the need for an associated container to contain spillage yet such an embodiment can include the necessary features and elements to permit additional trays to be suspended from it as is described below in greater detail.

Referring to FIGS. 1&2, the tray includes a plurality of openings/apertures 14 for receiving beverage containers therein for transport. As illustrated, the apertures are merely circular holes fabricated into the tray/plate. They are configured to hold frustoconical cups 36 having a bottom diameter less than that of the opening and a top diameter greater than that of the opening. A typical diameter of the apertures is about 3.0 inches. Accordingly, the cups become wedged in place when slid downwardly into the opening. In order to carry beverage receptacles that are substantially cylindrical, a boxlike tray with a supporting bottom surface is typically required.

Also, as shown in FIG. 2, a plurality of legs 13 may depend from a bottom surface of the tray 12 such that the tray will continue to support the cups 36 when the tray is placed on a horizontal surface. As shown, the legs comprise for cylindrical members approximately 1 to 2 inches long, located proximate the corners of the tray, although in variations, the legs may be configured differently or be omitted altogether.

A handle assembly attached to the tray 12. In the illustrated embodiments, the handle assembly comprises an inverted handle U-shaped member 16 comprised of aluminum rod that has threaded ends, and a pair of nuts 18 threaded on to the threaded ends. As shown, the ends are passed through a pair of handle apertures 20 in the tray prior to securing the handle assembly in place using the nuts. The nuts, which have a greater diameter than the handle apertures, brace against the bottom of the tray when tray is lifted using the handle. As necessary, washers may also be utilized in conjunction with the nuts.

Typically, the handle assembly is adapted to support the tray 12 in a substantially horizontal position such that any beverages held in the tray do not spill their contents. For instance, the handle of the illustrated embodiment is centered on the tray such that the unladen tray is balanced about the handle when the tray is held therefrom.

In other embodiments and variations, the handle assembly can vary substantially and significantly. The handle U-shaped member can be comprised of plastic or a composite and it can be molded so the handle is ergonomically shaped. Other handles can be flexible, such as a strap. Further, the means of attaching the handle to the tray can also vary substantially as would be obvious to one of ordinary skill in the art to which the invention pertains. For example, clips, eyehooks, loop and/or straps could be used to secure the handle to the tray in place of the threaded nuts 18. In some embodiments, a handle assembly substantially different from the illustrated assembly can be used. For instance, the assembly can comprise a pair of straps or even a pair of rigid generally u-shaped members that are attached to the corners of the tray and are brought, held or coupled together proximate their centers to form a handle.

The container 34 can be comprised of any suitable material of any suitable size and shape, but typically the size and dimensions of the container are complimentary to an associated tray. In certain embodiments of the beverage holder system, the tray 12 is designed and dimensioned to be received in and coupled to commonly available plastic containers. For instance, the 14.0" by 9.25" tray described above is configured to be received in the opening of a 15-quart container, model number 1754, produced by the Sterilite Corporation of Townsend, Mass., which has a top opening of approximately 15.5" by 9.75". Of course, this container and the associated dimensions are merely exemplary and systems utilizing other size containers are contemplated.

Of important note, concerning the illustrated container 34 is its overturned or hooked lip. The overturned lip is typically provided on containers to facilitate the connection of a snap on semi-resilient lid; however, in embodiments of the present invention including the illustrated embodiments, the overturned lid facilitates the secure fastening of the lower portions of the attachment mechanisms to the container as is discussed in greater detail below.

Figure 3A:
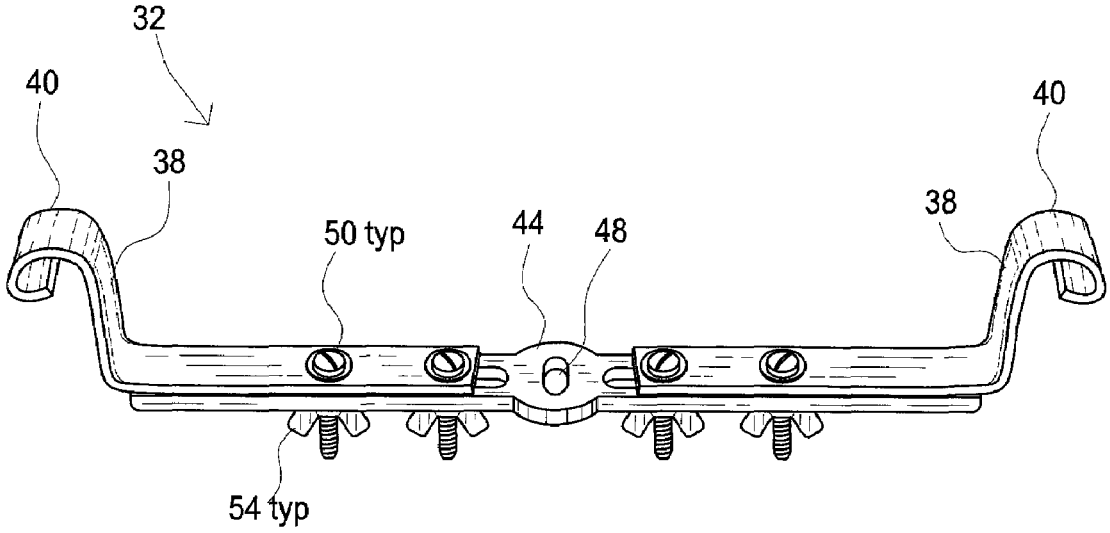
FIG. 3A is a partial isometric of the holder illustrating the attachment container mechanism according to an embodiment of the present invention.

The attachment mechanism facilitates the coupling of the tray 12 to the container 34 such that a user can lift the tray by way of the handle assembly with the container attached to the tray. Two attachment mechanisms are provided in the illustrated embodiment proximate the respective ends of the tray and container. Variations and other embodiments may use a single attachment mechanism or additional attachment mechanisms and the locations of the mechanisms can vary as well. The attachment mechanism comprises top or upper portion that is attached to the tray and a lower portion that is attached to the container. The top portion 24, 28 & 30 is best illustrated in FIG. 2. The lower portion 32 is best illustrated in FIGS. 3A&B.

The upper portion of the attachment mechanism comprises an elongated shaft 24 having a threaded end and a head comprising a key latch 26 adapted for receipt into an elongated slot. The elongated shaft is received through an attachment mechanism aperture 22 in the tray with the key latch being located underneath the bottom surface of the tray. The upper portion also includes a threaded wingnut 28 or finger hold that is threaded onto the threaded end of the elongated shaft. Typically, the wingnut is permanently or immovably secured to the shaft such that clockwise or counterclockwise rotation of the wingnut unitarily rotates the shaft and correspondingly the key latch therewith. In other words, rotation of the wingnut does not thread the wingnut further onto the shaft nor does it thread the wingnut off the shaft. Finally, the upper portion includes a coil spring 30 that is received on to the shaft between the bottom surface of the wingnut and the top surface of the tray. Accordingly, the coiled spring biases this shaft and the associated key latch upwardly.

The lower portion of the attachment mechanism includes a pair of opposing elongated clip members 38 each including a hooked end 40 adapted to be received around the overturned lip of the container 34. On a base portion of the clip member generally located opposite the hooked end, a pair of aligned holes 42 are provided for receiving screws therethrough. As clearly illustrated in FIGS. 3A&B, the hooked ends of the elongated clip members are located vertically above the base portions such that when the tray is coupled to the container its rests below the lip of the container a short distance (typically 0.25" to 1.50"). As can be appreciated by positioning the tray slightly below the lip of the container effectively prevents any liquid spilled onto the top of the tray from further spilling over the lip and onto an underlying surface.

The elongated clip members 38 are joined together by way of an elongated keyhole-spanning member 44. The elongated keyhole-spanning member includes a center portion wherein a rectangular or ovalized slot 48 is provided. The length of the slot is typically slightly longer than the length of the key latch 26. The width of the slot is typically slightly wider than the width of the key latch; however, the width is less than the length of the key latch.

Operationally to couple the upper and lower attachment portions, the key latch 26 is pushed through the slot 48 when the respective lengths of the slot and the key latch are aligned simultaneously compressing the coil spring 30. Once, passed through the slot, the user rotates the key latch 90 degrees using the fingerhold 28 and releases the fingerhold wherein the coil spring 30 biases the key latch via the shaft upwardly and against the bottom surface of the center portion thereby coupling the upper and lower portions of the attachment mechanism.

Figure 3B:
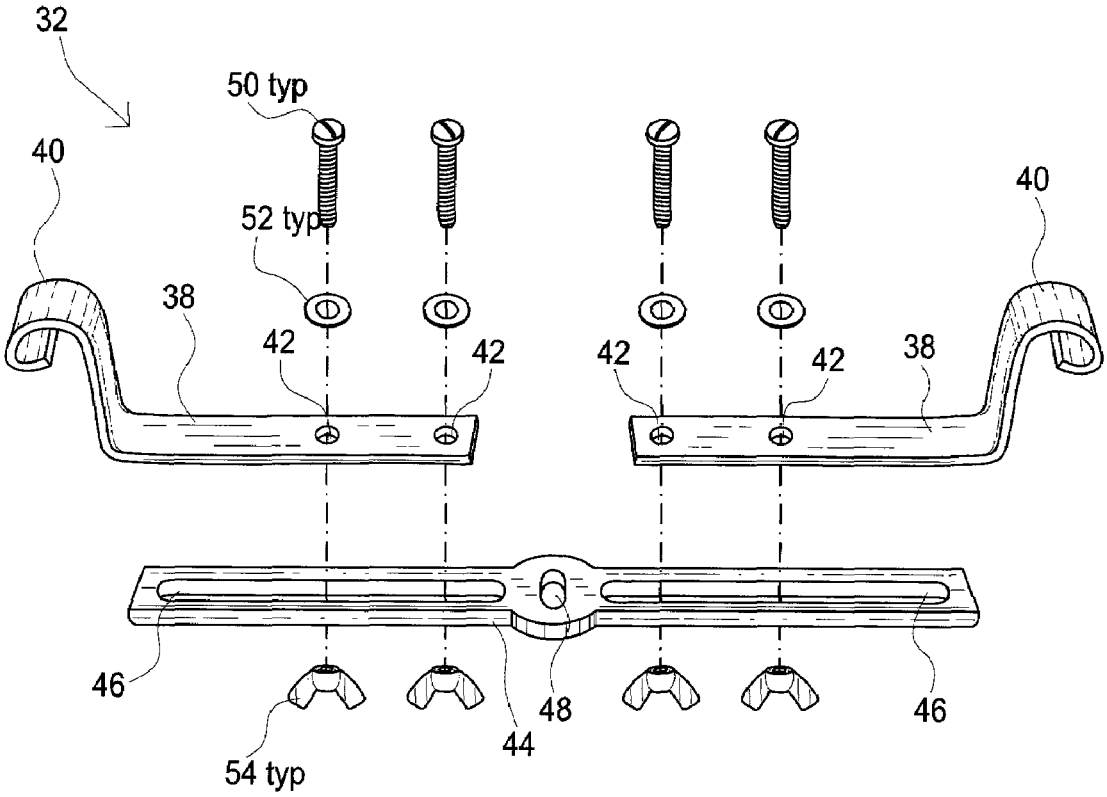
FIG. 3B is an exploded view of the attachment mechanism of FIG. 3A according to an embodiment of present invention.

Extending outwardly from the center portion of the keyhole-spanning member 44 are two aligned and opposing arms. A longitudinal adjustment slot 46 extends substantially along the entire length of each arm as shown in FIG. 3B. The slots are adapted to receiving screw fasteners 50 that extend through the aligned holes 42 of the clip members 38. The screws are used in conjunction with washers 52 and threaded nuts, such as the illustrated wingnuts 54 to attach and secure the clip members to the keyhole-spanning member at a set width corresponding to an associated widthwise dimension of the container 34.

To secure the lower portion 32 of the attachment mechanism to a container the wingnuts 54 are loosened and one or both clip members 38 are separated from the keyhole-spanning member 44. The hooks 40 of the clip members are hooked around the overturned lip of the container 34 such that the end of each hook is located underneath the bottom surface of the overturned lip. Next, the adjustment slots 46 are aligned with the aligned holes 42 with the key slot 48 being located substantially at the widthwise center of the container. The screws 50 are placed through the aligned holes and the adjustment slots and wingnuts 54 threaded and tightened onto the screw to secure the keyhole-spanning member to the respective left and right clip members.

Numerous variations of the upper and lower portions of the attachment mechanism are contemplated as would be obvious to one of ordinary skill in the art to which the invention pertains given the benefit of this disclosure. For instance, lower portions can be fabricated that do away with the adjustable length feature where the lower portion is configured to work with a container of a specific width. Other types of clipping mechanisms can be utilized to attach the upper and lower portions that may or may not utilize the rotatable key latch. In some embodiments, the attachment mechanisms may bear little resemblance to the type illustrated in this disclosure.

Figure 4:
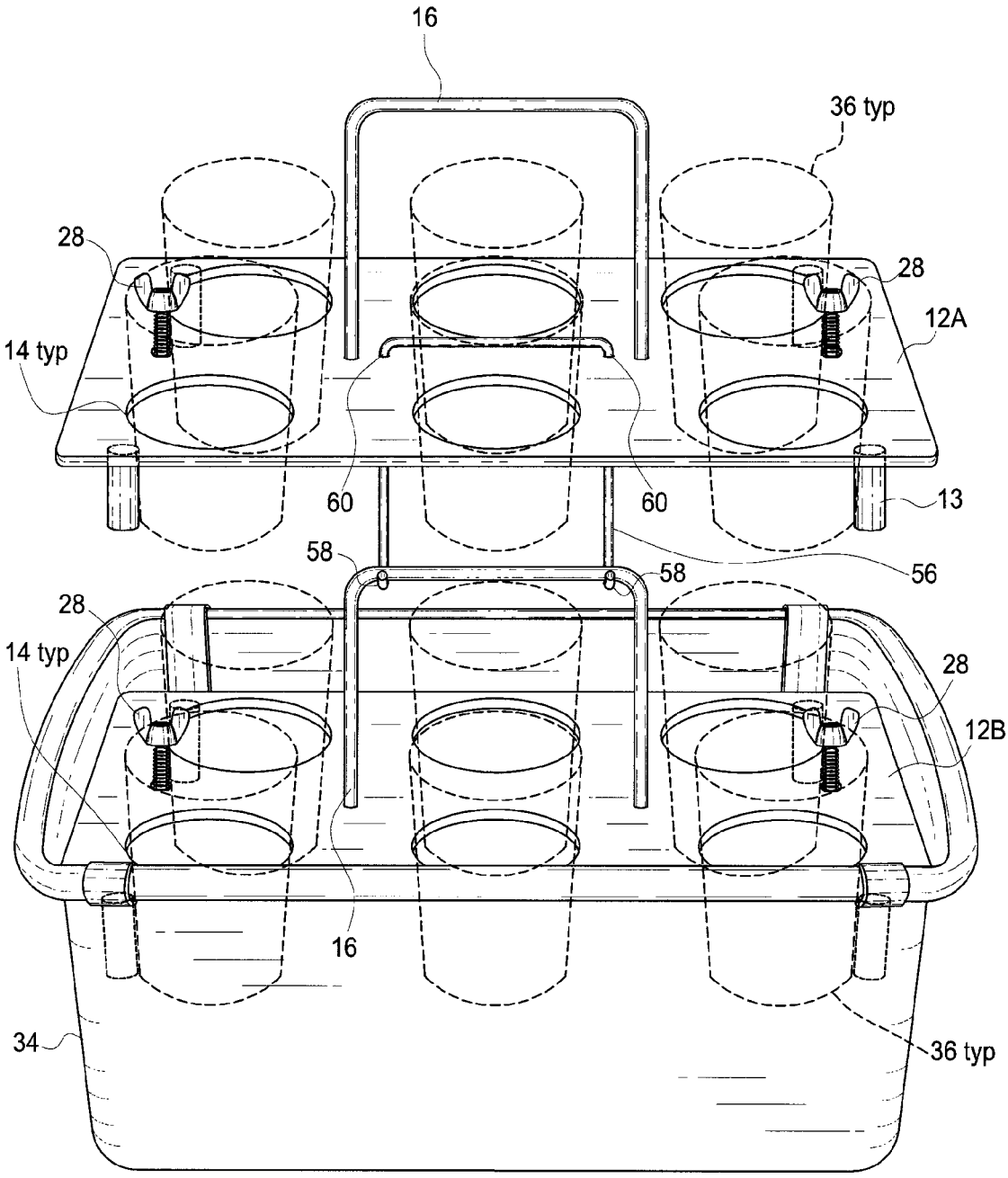
FIG. 4 is an isometric view of a double-decker variation of the beverage holder according to an embodiment of the present invention.

Referring to FIG. 4, a double-decker variation of the Beverage Holder and Transport System is shown wherein at least one lower tray 12B can be suspended from an upper tray 12A such that the total number beverages that can be transported at any given time is doubled. It is further appreciated that triple-decker or even quadruple-decker variations are also contemplated. Simply, the double-decker variation comprises upper and lower trays that despite an addition of an inverted hooked U-shaped member 56 with hooked ends 58 extending downwardly from the upper tray are substantially similar to the trays described in relations to FIGS. 1 & 2 above.

As shown in FIG. 4, both the upper and lower trays 12A&B include the upper portions of the attachment mechanism, and as shown, the lower tray is coupled to a container 34 by way an associated attachment mechanism. Considering that the upper tray with the downwardly extending inverted hooked U-shaped member 56 is generally adapted for use as an upper tray in a multiple tray configuration, in certain variations, the upper portion of the attachment mechanism may be eliminated therefrom.

The legs of the inverted hooked U-shaped member 56 pass through a pair of hook apertures 60 that are generally aligned with a center longitudinal axis of the upper tray as well as the handle apertures 20. The base of the hooked U-shaped member rests against the top surface of the upper tray. As mentioned the ends of the hooked U-shaped member 56 comprise hooks 58 sized to receive the base of the handle U-shaped member 16 of the lower tray therein, thus suspending the lower tray from the upper tray by way of the upper tray's hooked U-shaped member and the handle U-shaped member of the lower tray.

The apertures through which the legs of the inverted hooked U-shaped member are received are typically enough larger in diameter than the U-shaped member such that the U-shaped member can pivot back and forth as well as side to side within the holes. In one variation, the diameter of the hooked U-shaped member comprises an aluminum rod that is about 0.18" in diameter while the associated apertures are about 0.25" in diameter. Accordingly, when a person carrying two layers of drinks tilts the upper tray slightly off horizontal during transport, such as when walking, the inverted hooked U-shaped member 56 can slide in the apertures slightly to help maintain the horizontal orientation of the lower tray. Further, when the upper tray is lowered sans the lower tray, the inverted hooked U-shaped member slides upwardly in the associated apertures thereby permitting the tray to be set down on its legs 13 without the U-shaped member getting in the way.

The hook ends 58 of the inverted hooked U-shaped member 56, as shown, hook around the handle member 16 of the lower tray and permit the side to side pivoting or rocking of the lower tray relative to the upper tray also helping to maintain a laden lower tray in a horizontal position as a person carrying the double-decker arrangement walks. The hooks are generally open on one side such that a person holding the upper tray by the handle can position and swing the hooks over the handle of a laden lower tray set on a horizontal surface, such as a floor or tabletop, and lift the double-decker combination therefrom.

Conversely to detach the lower tray the user need only: (i) lower the combination until either the legs or the bottom of the container are set and supported on a horizontal surface; (ii) lower the upper tray a bit further until the handle of the lower tray separates from the hooks 58; and (iii) swing the upper tray to the side to move the hooks from under the lower tray's handle. The user may than transport the beverages contained in each separately or he/she can set the upper tray on a suitable horizontal surface or within a container having a lower portion 32 of an attachment mechanism.

In other variations and embodiments the inverted hooked U-shaped member can be replaced with other connectors including, but not limited to, hook bolts, open eyebolts and/or cables or chains having hook ends.

The beverage holder and transport system and its various components may be sold separately or in combination with each other. For instance, a user may be able to purchase a complete single system comprising the tray 12 with a handle 16 and upper and lower portions of a pair of attachment mechanisms. The container 34 may or may not be included as an off-the-shelf container may be available from other manufactures that can be separately purchased.

A double-decker system can include both upper and lower trays 12A&B with handle assemblies 16&18, a inverted hooked U-shaped member 56 with its hooked ends 58 to couple the trays, upper and lower portions of a pair of attachment mechanisms for the lower tray, and optionally, an upper portion of a pair of attachment mechanisms for the upper tray. A container 34 may also be provided in some system packages.

Alternatively, various components can be sold separately. For instance, the inverted hooked U-shaped member 56 can be sold by itself for use to convert any tray 12 for double-decker carrying duty. It is appreciated that all trays may include the necessary hook apertures 60 to receive the inverted hooked U-shaped member therein. Likewise, the attachment mechanisms may be sold separately from the tray assembly for those people who want to add the ability to attach a spill-catching container to their systems.

OTHER EMBODIMENTS AND VARIATIONS

The various embodiments and variations thereof illustrated in the accompanying Figures and/or described above are merely exemplary and are not meant to limit the scope of the invention. It is to be appreciated that numerous variations of the invention have been contemplated as would be obvious to one of ordinary skill in the art with the benefit of this disclosure.

For instance, the particular configuration of the trays can vary substantially as can the materials from which they are constructed. Trays that have compartments for each beverage cup formed therein are contemplated in place of a planar tray with beverage cup apertures. As also discussed above, the configurations of the various components can also vary sometimes substantially. The handles comprised of metallic rods can be replaced by injection molded plastic handles that have ergonomic grips and even apertures formed therein for receiving hooks to for a double-decker arrangement. Further, the attachment mechanisms can vary substantially and significantly in their configurations as would be obvious to one of ordinary skill in the art given the benefit of this disclosure.

I claim:

1. A beverage holder and transport system comprising:

a first plate, the first plate having a first plurality of cup apertures extending through the first plate;

a first handle assembly coupled to the first plate, the first handle assembly adapted to suspend the first plate in a horizontal orientation therefrom when a first handle portion of the first handle assembly is being held in the hand of a person.

a container, the container including an open end;

one or more attachment mechanisms, the one or more attachment mechanisms adapted to removably secure the plate to the container proximate the open end wherein the plurality of apertures overlie the container, the one or more attachment mechanisms being actuatable between secured and unsecured positions without appreciable canting of the plate relative to the container, each of the one or more attachment mechanisms including (i) a first portion of an attachment mechanism comprising (a) opposing first and second hooks, the first and second hooks adapted to fixedly clip over opposing portions of a rim of the container proximate the container's open end and (b) a spanning member coupling the first and second hooks, and (ii) a second portion of the attachment mechanism attached to the plate, the second portion comprising a latch adapted to securely couple and decouple the plate to the first portion; and wherein the coupled combination of the plate, the one or more attachment mechanisms, the container and the handle can be lifted simultaneously by way of the handle alone without any additional support of beverage holder and transport system.

2. The beverage holder and transport system of claim 1, wherein the first plurality of cup apertures comprise six apertures.

3. The beverage holder and transport system of claim 1, further including a plurality of legs extending downwardly from a bottom surface of the first plate.

4. The beverage holder and transport system of claim 1, wherein (i) the first plate is substantially rectangular having a plate length and plate width, (ii) the opening is also substantially rectangular having a opening length and an opening width and (iii) the opening width at a mouth of the container being greater than the plate width and the opening length at the mouth being greater than the plate length.

5. The beverage holder and transport system of claim 1, wherein the first handle assembly comprises (i) an inverted U-shaped member including a substantially horizontal handle portion and opposing vertical leg portions, the vertical leg portions extending through respective handle apertures in the plate, and (ii) a pair of end stops, each end stop being secured to a respective end of the vertical leg portions and having a width wise dimension greater than a diameter of the respective handle aperture.

6. The beverage holder and transport system of claim 5, wherein the first handle assembly located substantially proximate the center of the plate.

7. The beverage holder and transport system of claim 1, wherein each latch mechanism includes a key latch attached to a distal end of a rotatable shaft with a finger hold being attached to the shaft proximate an opposing end thereof, the shaft extending through a latch aperture in the plate.

8. The beverage holder and transport system of claim 1, further comprising:

a second plate, the second plate having a second plurality of cup apertures extending though the second plate;

a second handle assembly coupled to the second plate, the second handle assembly adapted to suspend the second plate in a horizontal orientation therefrom when a second handle portion of the second handle assembly is being held in the hand of a person; and one or more hooks depending downwardly from the second plate, the one or more hooks being positioned to hook around the first handle wherein the first plate pivotally hangs therefrom beneath the second plate.

9. The beverage holder and transport system of claim 8, wherein the one or more hooks comprises a pair of hooks, the pair of hooks being located at the ends of respective legs of an inverted U-shaped member, the respective legs passing though hook apertures in the second plate.

10. The beverage holder and transport system of claim 7, wherein the shaft and associated key latch are biased upwardly.

11. The beverage holder of claim 1, wherein the one or more attachment mechanisms comprise two attachment mechanisms.

12. A beverage cup holder for transporting a plurality of beverage filled receptacles, the holder comprising:

a first tray, the tray having a first plurality of receptacle apertures extending therethrough;

a second tray, the second tray having a second plurality of receptacle apertures extending therethrough, the second tray being removably and pivotally coupled with the first tray substantially directly beneath the first tray;

a first handle attached to the first tray and adapted to permit a user to carry the combination of the first and second trays by way of the handle with a single hand; and a second handle, the second handle being handle attached to the second tray and being adapted to permit the user to carry the second tray by way of the handle with the single hand sans the first tray.

13. The beverage holder of claim 12, further comprising one or more hooks depending from a bottom of the first tray, the one or more hooks being positioned to hook around the second handle.

14. The beverage holder of claim 13, wherein the one or more hooks comprises a pair of hooks, the pair of hooks being located at the ends of respective legs of an inverted U-shaped member.

15. The beverage holder of claim 12, wherein the first and second trays comprise plates.

16. The beverage holder of claim 12, wherein the first plurality of beverage receptacles apertures comprises four or more apertures and wherein the second plurality of beverage receptacles comprises four or more apertures.

17. The beverage holder of claim 12, further comprising:

a container, the container including an open end; and one or more attachment mechanisms, the one or more attachment mechanisms adapted to removably secure the second tray to the container proximate the open end wherein the second plurality of apertures overlie the container, the one or more attachment mechanisms being actuatable between secured and unsecured positions without appreciable movement of the second tray relative to the container.

* * * * *